United States Patent [19]

Shanton

[11] Patent Number: 4,462,616

[45] Date of Patent: Jul. 31, 1984

[54] RECORD MATERIAL

[75] Inventor: Kenneth J. Shanton, Beaconsfield, England

[73] Assignee: The Wiggins Teape Group Limited, Hampshire, England

[21] Appl. No.: 442,566

[22] Filed: Nov. 18, 1982

[30] Foreign Application Priority Data

Dec. 4, 1981 [GB] United Kingdom ..... 8136583

[51] Int. Cl.[3] ..... B41M 5/16; B41M 5/18; B41M 5/22

[52] U.S. Cl. ..... 346/210; 428/330; 428/913; 428/914; 346/211; 346/212; 346/219; 346/225

[58] Field of Search ..... 282/27.5; 427/150–153; 428/330, 320.4–320.8, 411, 488, 537, 913, 914

[56] References Cited

U.S. PATENT DOCUMENTS

| | | | |
|---|---|---|---|
| 2,505,484 | 4/1950 | Green | 282/27.5 |
| 2,505,485 | 4/1950 | Green | 282/27.5 |
| 2,505,486 | 4/1950 | Green | 282/27.5 |
| 2,505,489 | 4/1950 | Green | 282/27.5 |
| 2,505,781 | 4/1950 | Green | 282/27.5 |
| 2,618,573 | 11/1952 | Green | 282/27.5 |
| 2,702,765 | 2/1955 | Steinhardt | 282/27.5 |
| 3,330,722 | 7/1967 | Amano et al. | 282/27.5 |
| 3,980,492 | 9/1976 | Thompson | 282/27.5 |
| 4,022,735 | 5/1977 | Thompson | 282/27.5 |
| 4,038,097 | 7/1977 | Traxler et al. | 282/27.5 |
| 4,109,048 | 8/1978 | Dessaver et al. | 282/27.5 |

FOREIGN PATENT DOCUMENTS

| | | | |
|---|---|---|---|
| 2364255 | 7/1975 | Fed. Rep. of Germany | 282/27.5 |
| 3034486 | 11/1979 | Fed. Rep. of Germany | 282/27.5 |
| 666437 | 6/1949 | United Kingdom | 282/27.5 |
| 1271304 | 4/1972 | United Kingdom | 282/27.5 |
| 1451982 | 10/1976 | United Kingdom | 282/27.5 |
| 1467003 | 3/1977 | United Kingdom | 282/27.5 |
| 1497663 | 1/1978 | United Kingdom | 282/27.5 |

*Primary Examiner*—Bruce H. Hess
*Attorney, Agent, or Firm*—Burns, Doane, Swecker & Mathis

[57] ABSTRACT

Pressure- or heat-sensitive record material carries hydrated zirconia as a color developer material. The hydrated zirconia may be modified by the presence of compounds or ions of one or more multivalent metals.

2 Claims, No Drawings

RECORD MATERIAL

This invention relates to record material and to a process for the production of the record material. The record material may be, for example, part of a pressure-sensitive copying system or of a heat-sensitive recording system.

In one known type of pressure-sensitive copying system, usually known as a transfer system, an upper sheet is coated on its lower surface with microcapsules containing a solution of one or more colourless colour formers and a lower sheet is coated on its upper surface with a colour developing co-reactant material. A number of intermediate sheets may also be provided, each of which is coated on its lower surface with microcapsules and on its upper surface with colour developing material. Pressure exerted on the sheets by writing or typing ruptures the microcapsules, thereby releasing the colour former solution on to the colour developing material on the next lower sheet and giving rise to a chemical reaction which develops the colour of the colour former. In a variant of this system, the microcapsules are replaced by a coating in which the colour former solution is present as globules in a continuous matrix of solid material.

In another type of pressure-sensitive copying system, usually known as a self-contained or autogeneous system, microcapsules and colour developing co-reactant material are coated onto the same surface of a sheet, and writing or typing on a sheet placed above the thus-coated sheet causes the microcapsules to rupture and release the colour former, which then reacts with the colour developing material on the sheet to produce a colour.

Heat-sensitive recording systems frequently utilise the same type of reactants as those described above to produce a coloured mark, but rely on heat to convert one or both reactants from a solid state in which no reaction occurs to a liquid state which facilitates the colour-forming reaction, for example by dissolution in a binder which is melted by the heat applied.

The sheet material used in such systems is usually of paper, although in principle there is no limitation on the type of sheet which may be used. When paper is used, the colour developing co-reactant material and/or the microcapsules may be present as a loading within the sheet material instead of as a coating on the sheet material. Such a loading is conveniently introduced into the papermaking stock from which the sheet material is made.

Zirconia, i.e. zirconium dioxide, $ZrO_2$, has long been recognised as a material suitable as a co-reactant for developing the colour of colour formers for use in record material, see for example U.S. Pat. Nos. 2,505,470 and 2,777,780. However, whilst it is quite effective when in powder form for developing the colour of a solution of a colour former such as crystal violet lactone, it is much less effective when coated on to paper as the active component of a colour developer composition, probably because its reactivity is suppressed by the presence of conventional paper coating binders, for example latex binders. A further problem is that the colour developed initially is very prone to fading.

It has now unexpectedly been found that hydrated zirconia affords good colour developing properties whilst being much less susceptible to the problems which are experienced with zirconia, particularly if the hydrated zirconia is modified by the presence of suitable metal compounds or ions. Hydrated zirconia, which is alternatively known as hydrous zirconia, may be represented by the formula $ZrO_2.xH_2O$.

According to a first aspect of the invention, there is provided record material carrying hydrated zirconia as a colour developer.

According to a second aspect of the invention, there is provided a process for the production of record material, comprising the steps of:

(a) forming an aqueous dispersion of hydrated zirconia;

(b) either:

(i) formulating said dispersion into a coating composition and applying the coating composition to a substrate web; or (ii) introducing said dispersion into papermaking stock and forming a paper web which incorporates said composite as a loading; and (c) drying the resulting coated or loaded web to produce said record material.

The hydrated zirconia used in the present process may have been prepared previously, for example it may be a commercially available material or it may be precipitated in an aqueous medium, as an initial stage in the process for preparing the record material. The hydrated zirconia may be precipitated from the aqueous medium in various ways, for example by precipitation from an aqueous solution of a zirconium salt on addition of aqueous alkali; by addition of an aqueous solution of a zirconium salt to excess aqueous alkali, followed by neutralization; or by mixing an aqueous solution of a zirconium salt and an aqueous alkali in proportions such as to maintain a substantially neutral pH throughout the mixing stage. The zirconium salt may for example be zirconyl chloride or zirconium sulphate. The aqueous alkali may for example be a solution of sodium, potassium, lithium or ammonium hydroxide.

Instead of the use of a cationic zirconium salt, the hydrated zirconia may be precipitated from a solution of a zirconate, for example ammonium tris-carbonato zirconate, by addition of acid, for example a mineral acid such as sulphuric acid or hydrochloric acid.

In a preferred embodiment of the present invention, the hydrated zirconia is modified by the presence of a compound or ions of one or more multivalent metals, for example copper, nickel, manganese, cobalt, chromium, zinc, magnesium, titanium, tin, calcium, tungsten, iron, tantalum, molybdenum or niobium. Such modification will hereafter be referred to as "metal modification".

Metal modification may conveniently be brought about by treating the hydrated zirconia, once formed, with a solution of the metal salt, for example of the sulphate or chloride. Alternatively, a solution of the metal salt may be introduced into the medium from which the hydrated zirconia is precipitated.

The precise nature of the species formed during metal modification has not so far been fully elucidated, but one possibility is that a metal oxide or hydroxide is precipitated so as to be present in the hydrated zirconia. An alternative or additional possibility is that ion-exchange occurs so that metal ions are present at ion-exchange sites on the surface of the hydrated zirconia.

Metal modification enables improvements to be obtained in the initial intensity and/or fade resistance of the print obtained from hydrated zirconia with both so-called rapid-developing and so-called slow developing colour formers, and with colour formers intermediate to these categories.

Categorisation of colour formers according to the speed with which their colour may be developed has long been a common practice in the art. 3,3-Bis (4'-dimethylaminophenyl)-6-dimethylaminophthalide (CVL) and similar lactone colour formers are typical of the rapid-developing class, in which colour formation results from cleavage of the lactone ring on contact with an acid co-reactant. 10-Benzoyl-3,7-bis(dimethylamino)phenothiazine (more commonly known as benzoyl leuco methylene blue or BLMB) and 10-benzoyl-3,7-bis(diethylamino) phenoxazine (also known as BLASB) are examples of the slow-developing class. It is generally believed that formation of a coloured species is a result of slow hydrolysis of the benzoyl group over a period of up to about two days, followed by aerial oxidation. Spiro-bipyran colour formers, which are widely disclosed in the patent literature, are examples of colour formers in the intermediate category.

The effect achieved by metal modification depends in substantial measure on the particular metal involved and on the particular colour former(s) being used, as will become clear from consideration of the Examples set out hereafter.

The production of hydrated zirconia by any of the process routes described earlier may take place in the presence of a polymeric rheology modifier such as the sodium salt of carboxymethylcellulose (CMC), polyethyleneimine or sodium hexametaphosphate. The presence of such a material modifies the rheological properties of the resulting dispersion of hydrated zirconia and thus results in a more easily agitatable, pumpable and coatable composition, possibly by having a dispersing or flocculating action. It may be advantageous to precipitate the hydrated zirconia in the presence of a particulate material which may function as a carrier or nucleating agent. Suitable particulate materials for this purpose include kaolin, calcium carbonate or other materials commonly used as pigments, fillers or extenders in the paper coating art, since these materials will often need to be included in the coating composition used in the production of a coated record material or in the papermaking stock used in the production of a loaded record material.

A coating composition for use in the production of the present record material will normally also contain a binder (which may be wholly or in part constituted by the CMC optionally used as a rheology modifier during the preparation of the colour developing material) and/or a filler or extender, which typically is kaolin, calcium carbonate or a synthetic paper coating pigment, for example a urea-formaldehyde resin pigment. The filler or extender may be wholly or in part constituted by the particulate material which may be used during the preparation of the hydrated zirconia. In the case of a loaded record material, a filler or extender may also be present, and again this may be wholly or in part constituted by the particulate material which may be used during the preparation of the hydrated zirconia.

The pH of the coating composition influences the subsequent colour developing performance of the composition, and also its viscosity, which is significant in terms of the ease with which the composition may be coated on to paper or other sheet material. The preferred pH for the coating composition is within the range 5 to 9.5, and is preferably around 7.0. Sodium hydroxide is conveniently used for pH adjustment, but other alkaline materials may be used, for example potassium hydroxide, lithium hydroxide, calcium hydroxide or ammonium hydroxide.

The aqueous dispersion which is formulated into the coating composition or introduced into the papermaking stock may be a dispersion obtained as a result of precipitation of hydrated zirconia from an aqueous medium. Alternatively, the hydrated zirconia may be separated after its preparation, e.g. by filtering off, and then washed to remove soluble salts before being re-dispersed in a further aqueous medium to form the dispersion for formulation into the coating composition or introduction into the papermaking stock. The latter procedure tends to give rise to more intense colour developing properties.

The hydrated zirconia may be used as the only colour developing material in a colour developing composition, or it may be used in simple admixture with other conventional colour developing materials, e.g. an acid-washed dioctahedral montmorillonite clay. It will be appreciated however that such admixtures are to be distinguished from colour developing composites or reaction products of hydrated zirconia with inorganic materials such as hydrated silica and/or hydrated alumina, or organic materials such as aromatic carboxylic acids, which are not within the scope of the present invention.

It is usually desirable to treat the hydrated zirconia in order to break up any aggregates which have formed, for example by ball-milling. This treatment may be carried out either before or after the optional addition of fillers and/or additional colour developing materials.

In the case of a coated record material, the record material may form part of a transfer or self-contained pressure-sensitive copying system or of a heat-sensitive recording system as described previously. In the case of a loaded record material, the record material may be used in the same manner as the coated record material just described, or the record material may also carry microencapsulated colour former solution as a loading, so as to be a self-contained record material.

The invention will now be illustrated by the following Examples (in which all percentages quoted are by weight):

Example 1

This illustrates the preparation of hydrated zirconia by precipitation from an initially acidic medium.

1.2 g of CMC (FF5 supplied by Finnfix) were dissolved in 105 g of de-ionized water over a period of 15 minutes with stirring. 45 g of zirconyl chloride, $ZrOCl_2.8H_2O$ were then added, giving an acidic solution, and sufficient 40% w/w sodium hydroxide solution was added slowly with stirring to return the pH to 7, with resultant precipitation of hydrated zirconia.

The mixture was left stirring for an hour. 10 g of kaolin (Dinkie A supplied by English China Clays) were then added and the mixture was stirred for 30 minutes after which 10.0 g of styrene-butadiene latex (Dow 675) were added. The pH was re-adjusted to 7. The resulting mixture was then left stirring overnight before being coated on to paper at a nominal dry coat-weight of 8 $gm^{-2}$ using a laboratory Meyer bar coater. The coated sheet was dried and calendered and then subjected to calender intensity and fade resistance tests to assess its performance as a colour developing material.

The calender intensity test involved superimposing a strip of paper coated with encapsulated colour former solution on a strip of the coated paper under test, passing the superimposed strips through a laboratory calender to rupture the capsules and thereby produce a colour on the test strip, measuring the reflectance of the coloured strip (I) and expressing the results (I/Io) as a percentage of the reflectance of an unused control strip (Io). Thus the lower the calender intensity value (I/Io) the more intense the developed colour. The calender intensity tests were done with two different papers, designated hereafter as Papers A and B. Paper A employed a commercially used blue colour former blend containing, inter alia, CVL as a rapid-developing colour former and BLASB as a slow-developing colour former. Paper B employed a commercially used black colour former blend also including CVL and BLASB.

The reflectance measurements were done both two minutes after calendering and again after forty-eight hours, the samples being kept in the dark in the interim. The colour developed after two minutes is primarily due to the rapid-developing colour formers, whereas the colour after forty-eight hours derives also from the slow-developing colour formers, (fading of the colour from the rapid-developing colour formers also influences the intensity achieved).

The fading test involved positioning the developed strips (after forty-eight hours development) in a cabinet in which were an array of daylight fluorescent striplamps. This is thought to simulate, in accelerated form, the fading which a print might undergo under normal conditions of use. After exposure for the desired time, measurements were made as described with reference to the calender intensity test, and the results were expressed in the same way.

The calender intensity and fade resistance results were as follows:

| Test Conditions | Paper A | Paper B |
|---|---|---|
| 2 min. development | 59.9 | 65.6 |
| 48 hours development | 43.4 | 49.8 |
| 1 hour fade | 42.3 | 47.3 |
| 3 hours fade | 45.3 | 49.1 |
| 5 hours fade | 48.5 | 51.7 |
| 10 hours fade | 55.2 | 57.6 |
| 15 hours fade | 62.5 | 63.5 |

Example 2

This illustrates the precipitation of hydrated zirconia from an initially alkaline medium.

1.2 g of CMC (FF5) were dissolved in 105 g of deionized water over a period of 15 minutes with stirring, and sufficient sodium hydroxide solution was added to give a pH of 10.0. 45 g of zirconyl chloride, $ZrOCl_2.8H_2O$ were then added slowly with stirring, and the pH was then adjusted to 7 by the slow addition of 40% w/w sulphuric acid. The mixture was left stirring for an hour. 10 g of kaolin (Dinkie A) were then added and the mixture was stirred for 30 minutes, after which 10.0 g of styrene-butadiene latex (Dow 675) were added. The resulting mixture was then left stirring overnight before being coated on to paper with a nominal dry coatweight of 8 $gm^{-2}$ using a laboratory Meyer bar coater. The coated sheet was dried and calendered and then subjected to calender intensity and fade resistance tests to assess its performance as a colour developing material.

The calender intensity and fade resistance results were as follows:

| Test Conditions | Paper A | Paper B |
|---|---|---|
| 2 min. development | 61.4 | 65.8 |
| 48 hour development | 48.7 | 52.9 |
| 1 hour fade | 45.0 | 47.0 |
| 3 hour fade | 51.4 | 50.3 |
| 5 hour fade | 54.5 | 54.3 |
| 10 hour fade | 63.0 | 61.3 |
| 15 hour fade | 69.3 | 63.5 |

Example 3

This illustrates the precipitation of hydrated zirconia from a neutral medium.

1.2 g of CMC (FF5) were dissolved in 30 g of de-ionized water over a period of 15 minutes with stirring. A solution of 45 g zirconyl chloride, $ZrOCl_2.8H_2O$ in 75 g de-ionized water was then added dropwise, and simultaneously sodium hydroxide solution was added in an amount sufficient to maintain a substantially constant pH of 7. The mixture was left stirring for an hour. 10 g of kaolin (Dinkie A) were then added and the mixture was stirred for 30 minutes, after which 10.0 g of styrene-butadiene latex (Dow 675) were added. The resulting mixture was then left stirring overnight before being coated on to paper at a nominal dry coatweight of 8 $gm^{-2}$ using a laboratory Meyer bar coater. The coated sheet was dried and calendered and then subjected to calender intensity and fade resistance tests to assess its performance as a colour developing material.

The calender intensity and fade resistance results were as follows:

| Test Conditions | Paper A | Paper B |
|---|---|---|
| 2 min. development | 64.3 | 68.2 |
| 48 hour development | 51.1 | 56.5 |
| 1 hour fade | 49.1 | 51.9 |
| 3 hour fade | 52.7 | 54.5 |
| 5 hour fade | 56.9 | 57.2 |
| 10 hour fade | 62.1 | 61.4 |
| 15 hour fade | 66.6 | 66.2 |

Example 4

This illustrates the performance of hydrated zirconia as a colour developer for various colour formers, using a coating composition prepared in the same manner as described in Example 1.

The calender intensity and fade resistance results with a series of papers (Papers C to G) carrying capsules containing a single colour former in solution were as follows:

| Test Condition | C | D | E | F | G | H* |
|---|---|---|---|---|---|---|
| 2 min development | 76.9 | 100 | 70.6 | 68.5 | 99.6 | 81.7 |
| 48 hour development | 75.9 | 82.0 | 62.7 | 64.1 | 78.7 | 77.6 |
| 1 hour fade | 76.2 | 75.7 | 62.5 | 63.2 | 65.9 | 77.5 |
| 3 hour fade | 78.7 | 73.0 | 68.6 | 64.8 | 66.2 | 77.6 |
| 5 hour fade | 80.7 | 72.6 | 73.7 | 67.0 | 66.4 | 77.9 |
| 10 hour fade | 87.8 | 71.9 | 83.1 | 72.3 | 68.7 | 80.5 |
| 15 hour fade | 92.1 | 71.3 | 92.1 | 75.5 | 74.2 | 81.4 |

The encapsulated colour former(s) carried by Papers C to G were as follows:

Paper C—"Pergascript Olive I-G", a green-black colour former sold by Ciba-Geigy

Paper D—BLASB

Paper E—CVL

Paper F—"Pyridyl Blue", i.e. one or both of the isomeric compounds 5-(1'-ethyl-2'-methylindol-3'-yl)-5-4''-diethylamino-2''-ethoxyphenyl)-5,7-dihydrofuro(3,4-b)pyridin-7-one and 7-(1'-ethyl-2'-methylindol-3'-yl)-7-(4''-diethylamino-2''-ethoxyphenyl)-5,7-dihydrofuro(3,4-b)pyridin-5-one Paper G—"Pergascript Blue BP 558"—a slow-developing blue colour former sold by Ciba-Geigy Paper H—"Indolyl Red", i.e. 3,3-bis(1'-ethyl-2'-methylindol-3'-yl)phthalide.

In all cases except for colour former H the colour former was present as a 1% solution in a solvent blend comprising partially hydrogenated terphenyls (80%) and kerosene (20%). Colour former H was applied as a 0.65% solution in a solvent blend comprising partially hydrated terphenyls (75%) and kerosene (25%).

Example 5

This repeated the procedure of Example 1, but the coating composition obtained after the addition of kaolin and latex was coated on to paper shortly after it had been prepared, rather than being stored overnight. This resulted in improved colour developing performance, as can be seen from the calender intensity and fade resistance results obtained with Papers A and B, which were as follows:

| Test Conditions | Paper A | Paper B |
|---|---|---|
| 2 mins. development | 54.3 | 60.0 |
| 48 hour development | 37.3 | 44.3 |
| 1 hour fade | 37.2 | 43.2 |
| 3 hour fade | 42.0 | 45.0 |
| 5 hour fade | 46.4 | 48.7 |
| 10 hour fade | 55.2 | 54.6 |
| 15 hour fade | 57.5 | 59.2 |

Example 6

This illustrates the use of zirconium sulphate rather than zirconyl chloride as the source of zirconium.

The procedure used was as described in Example 1 except that the following quantities of material were used:

| | |
|---|---|
| de-ionized water | 57.5 g |
| CMC | 0.6 g |
| zirconium sulphate, $Zr(SO_4)_2.4H_2O$ | 25.0 g |
| kaolin | 5.0 g |
| latex | 5.0 g |

The calender intensity results obtained with Papers A, B and E were as follows:

| Test Conditions | Paper A | Paper B | Paper E |
|---|---|---|---|
| 2 min. development | 66.4 | 70.8 | 73.0 |
| 48 hour development | 48.8 | 56.6 | 67.1 |

Example 7

This illustrates the use of alternative alkaline materials (lithium, potassium and ammonium hydroxides) to the sodium hydroxide solution used in the previous Examples. The procedure was as described in Example 1, and the calender intensity results obtained with Papers A, B and E were as follows:

| Test Conditions | Alkali | | | | | | | | |
|---|---|---|---|---|---|---|---|---|---|
| | LiOH Paper | | | KOH Paper | | | $NH_4OH$ Paper | | |
| | A | B | E | A | B | E | A | B | E |
| 2 min. development | 62.2 | 66.6 | 70.4 | 69.4 | 74.0 | 73.4 | 74.1 | 73.0 | 84.4 |
| 48 hour development | 45.3 | 51.9 | 65.7 | 42.6 | 52.8 | 59.2 | 55.1 | 56.5 | 76.0 |

Example 8

This illustrates the effect of ball-milling the coating composition. The procedure was as described in Example 6 (using zirconium sulphate) except that after the addition of kaolin and latex, the mixture was ball-milled overnight to give a mean particle size of approximately 3$\mu$ when measured by the Andreasen Sedimentation Pipette method. The results of calender intensity and fade resistance tests with Papers A, B and E were as follows:

| Test Conditions | Paper A | Paper B | Paper E |
|---|---|---|---|
| 2 min. development | 63.7 | 68.5 | 71.5 |
| 48 hour development | 44.7 | 52.8 | 62.4 |
| 1 hour fade | 44.0 | 48.6 | 66.4 |
| 15 hour fade | 63.5 | 60.1 | 89.6 |

It will be seen that ball-milling gave slightly improved colour developing performance.

Example 9

This illustrates the production of copper-modified hydrated zirconia.

The procedure employed was as in Example 1, except that after hydrated zirconia was precipitated by adjusting the pH to 7, 20 g of 25% w/w solution of copper sulphate, $CuSO_4.5H_2O$ were slowly added, and the pH was re-adjusted to 7 if necessary. Stirring was then contained for a further hour before continuing the Example 1 procedure by the addition of kaolin.

A parallel preparation omitting the addition of copper sulphate solution was also carried out for comparison purposes.

The sheets prepared were subjected to calender intensity and fade resistance tests with Papers A and B, and the results were as follows:

| Test Conditions | Copper modified | | Unmodified | |
|---|---|---|---|---|
| | Paper A | Paper B | Paper A | Paper B |
| 2 min. development | 43.5 | 56.7 | 52.3 | 60.5 |
| 48 hour development | 40.9 | 46.9 | 42.0 | 52.6 |
| 16 hour fade | 45.7 | 50.7 | 66.9 | 68.5 |

It will be seen that copper modification resulted in a significant improvement in initial intensity and a major improvement in fade resistance.

Example 10

This illustrates the use of a range of different metals in the production of metal-modified hydrated zirconia.

The procedure described in Example 9 was repeated, except that in place of the copper sulphate solution, the following were used:

| Material | | Wt (g) |
|---|---|---|
| (a) calcium sulphate | $CaSO_4$ | 2.2 |
| (b) cobalt sulphate | $CoSO_4.7H_2O$ | 4.5 |
| (c) magnesium sulphate | $MgSO_4$ | 1.9 |
| (d) nickel sulphate | $NiSO_4.7H_2O$ | 4.2 |
| (e) zinc sulphate | $ZnSO_4.7H_2O$ | 4.6 |
| (f) tin chloride | $SnCl_4.5H_2O$ | 5.6 |

A repeat of the procedure with copper sulphate was also carried out, together with a procedure in which no modifying metal was used.

The resulting papers were tested for calender intensity and fade resistance and the results were as follows:

| Test | Modifying metal | | | |
|---|---|---|---|---|
| | Ca | | Co | |
| Conditions | Paper A | Paper B | Paper A | Paper B |
| 2 min. development | 46.1 | 53.6 | 62.0 | 63.6 |
| 48 hour development | 37.2 | 43.9 | 48.0 | 48.7 |
| 1 hour fade | 37.6 | 42.2 | 63.6 | 57.9 |
| 3 hour fade | 44.5 | 47.6 | 65.3 | 58.8 |
| 5 hour fade | 49.9 | 52.9 | 65.2 | 60.2 |
| 10 hour fade | 61.1 | 61.3 | 68.5 | 62.1 |
| 15 hour fade | 67.0 | 66.7 | 70.3 | 64.7 |
| 30 hour fade | 73.1 | 77.5 | 71.9 | 66.5 |
| 50 hour fade | 79.1 | 83.1 | 77.1 | 71.7 |
| 100 hour fade | 91.3 | 92.6 | 82.8 | 79.0 |

| Test | Modifying metal | | | |
|---|---|---|---|---|
| | Mg | | Ni | |
| Conditions | Paper A | Paper B | Paper A | Paper B |
| 2 min. development | 48.5 | 56.6 | 47.0 | 55.6 |
| 48 hour development | 39.9 | 47.0 | 38.1 | 46.3 |
| 1 hour fade | 38.8 | 44.1 | 37.2 | 42.3 |
| 3 hour fade | 45.3 | 48.2 | 38.0 | 44.6 |
| 5 hour fade | 51.4 | 53.7 | 40.8 | 46.1 |
| 10 hour fade | 63.6 | 62.3 | 47.3 | 49.5 |
| 15 hour fade | 67.7 | 67.5 | 52.6 | 54.6 |
| 30 hour fade | 75.7 | 77.7 | 56.2 | 59.0 |
| 50 hour fade | 82.8 | 85.0 | 64.3 | 65.6 |
| 100 hour fade | 91.4 | 93.4 | 72.9 | 77.0 |

| Test | Modifying metal | | | |
|---|---|---|---|---|
| | Zn | | Sn | |
| Conditions | Paper A | Paper B | Paper A | Paper B |
| 2 min. development | 43.8 | 51.9 | 46.9 | 54.7 |
| 48 hour development | 35.3 | 43.6 | 38.6 | 46.6 |
| 1 hour fade | 36.0 | 42.1 | 41.9 | 45.1 |
| 3 hour fade | 42.9 | 46.2 | 50.4 | 57.6 |
| 5 hour fade | 47.8 | 50.5 | 57.4 | 58.7 |
| 10 hour fade | 58.4 | 58.4 | 66.2 | 66.6 |
| 15 hour fade | 64.0 | 63.7 | 70.3 | 72.2 |
| 30 hour fade | 72.3 | 71.5 | 78.7 | 81.1 |
| 50 hour fade | 80.1 | 78.9 | 84.6 | 86.3 |

-continued

| Test | Modifying metal | | | |
|---|---|---|---|---|
| | Zn | | Sn | |
| Conditions | Paper A | Paper B | Paper A | Paper B |
| 100 hour fade | 90.8 | 90.5 | 93.1 | 94.5 |

| Test | Modifying metal | | | |
|---|---|---|---|---|
| | Cu | | None | |
| Conditions | Paper A | Paper B | Paper A | Paper B |
| 2 min. development | 53.9 | 54.3 | 63.0 | 67.5 |
| 48 hour development | 39.9 | 45.7 | 46.0 | 51.5 |
| 1 hour fade | 39.8 | 46.0 | 44.3 | 48.1 |
| 3 hour fade | 40.2 | 46.8 | 50.9 | 51.6 |
| 5 hour fade | 44.8 | 48.5 | 58.0 | 57.4 |
| 10 hour fade | 50.0 | 52.5 | 66.7 | 63.9 |
| 15 hour fade | 56.4 | 56.2 | 74.8 | 70.1 |
| 30 hour fade | 62.6 | 62.7 | 80.9 | 78.5 |
| 50 hour fade | 72.9 | 67.9 | 87.3 | 85.9 |
| 100 hour fade | 78.3 | 77.0 | 95.7 | — |

It will be seen that all the modifying metals improved initial intensity and fade resistance compared with unmodified hydrated zirconia, with both Papers A and B, except for zinc modified zirconia with Paper B. Zinc modification did however markedly improve initial intensity, and gave significantly improved fade resistance with Paper A.

Comparative Example 1

This compares the colour developing properties of hydrated zirconia with that of a commercially available zirconium dioxide (that supplied as a laboratory reagent by BDH Chemicals).

45 g of zirconyl chloride were dissolved in 150 g of de-ionized water, and the pH was adjusted to 7 by the addition of aqueous ammonia with stirring. A white precipitate was obtained. The precipitate was separated by filtration and then washed with de-ionized water, after which it was dried for three hours at 30° C. in a laboratory fluid bed drier. The dried material was then ground using a mortar and pestle to give a fine white powder approximating in fineness to that of the BDH zirconium dioxide.

1 g samples of the ground dried hydrated zirconia and of the BDH zirconium dioxide were each stirred overnight with 10 g of a 0.1% w/w solution of CVL in toluene. Each mixture was blue. The toluene was removed in each case by filtration, and the filtered off blue powders were each washed with toluene to remove any excess CVL, after which they were air-dried. To the naked eye, the hydrated zirconia sample was of a noticeably more intense blue colour than the zirconium dioxide.

Each sample was then placed in the sample holder of a MacBeth MS-2000 spectrophotometer, and its reflectance spectrum was obtained. In order to permit proper comparison of the colour developing performance of the two samples, Kubelka-Munk functions (K/S) at 20 nm wavelength intervals were derived from the reflectance data by computer processing. The greater the K/S value, the more intense the colour. At the wavelength of maximum absorption (600 nm), the K/S value for hydrated zirconia was 2.43, and that for BDH zirconium dioxide was 1.29, indicating that the colour developing performance of the hydrated zirconia was much superior to that of the BDH zirconium dioxide.

Comparative Example 2

This compares the performance of a colour developer sheet in accordance with the present invention with a colour developer sheet carrying a commercially available non-hydrated zirconia (Fisons SLR grade) as a colour developer.

The colour developer sheet according to the invention was prepared as follows:

130.9 g of 30% w/w solution of zirconyl chloride, $ZrOCl_2.8H_2O$ were dissolved in 305.4 g of de-ionized water and 113.8 g of 10N sodium hydroxide solution were added rapidly with stirring to give a pH of 7.0. A white precipitate of hydrated zirconia was obtained. This precipitate was filtered off, washed and redispersed in de-ionized water, and the procedure repeated until the dispersion was free of chloride ions, as determined by the silver nitrate test. This dispersion was then passed through a continuous laboratory ball mill, after which it was filtered. The precipitate was then re-dispersed in de-ionized water and 17.6 g of 50% solids content styrene-butadiene latex binder (Dow 675) were added, so as to give a 15% latex content on a dry weight basis. The pH was adjusted to 7.0 and sufficient de-ionized water was added to lower the viscosity of the mixture to a level suitable for coating using a laboratory Meyer Bar coater. The mixture was then coated on to paper at a nominal dry coatweight of 8 $gm^{-2}$, and the coated sheet was dried and calendered.

The colour developer sheet carrying non-hydrated zirconia was made by slurrying 50 g of zirconia in 75 g of de-ionized water, and then repeating the procedure described above from the stage of adding latex onwards.

The sheets were each subjected to calendar intensity tests, and the results were as follows:

| Test Conditions | Colour Developer | |
|---|---|---|
| | Hydrated Zirconia | Zirconia |
| 2 min. development | 44.4 | 88.4 |
| 48 hour development | 34.5 | 79.0 |

It will be seen that although zirconia functions as a colour developer, the sheet carrying hydrated zirconia showed markedly superior colour developer properties.

Example 11

This demonstrates the suitability of a typical example of a colour developer according to the invention for use in heat-sensitive record material.

20 g of a washed and dried hydrated zirconia prepared by the method of Comparative Example 2 were mixed with 48 g of stearamide wax and ground in a pestle and mortar. 45 g of de-ionized water and 60 g of 10% w/w poly(vinyl alcohol) solution (that supplied as "Gohsenol GL05" by Nippon Gohsei of Japan) were added and the mixture was ball-milled overnight. A further 95 g of 10% w/w poly(vinyl alcohol) solution were then added, together with 32 g de-ionized water.

In a separate procedure, 22 g of a black colour former (2'-anilino-6'-diethylamino-3'-methylfluoran), were mixed with 42 g de-ionized water and 100 g of 10% w/w poly(vinyl alcohol) solution, and the mixture was ball-milled overnight.

The suspensions resulting from the above procedures were then mixed and coated on to paper by means of a laboratory Meyer bar coater at a nominal coat weight of 8 $gm^{-2}$. The paper was then dried.

On subjecting the coated surface to heat, a black colouration was obtained.

I claim:

1. Record material carrying hydrated zirconia as a colour developer.

2. Record material as claimed in claim 1, characterized in that the hydrated zirconia is modified by the presence of a compound or ions of a multivalent metal.

* * * * *